US010947781B2

(12) United States Patent
Raggini

(10) Patent No.: US 10,947,781 B2
(45) Date of Patent: Mar. 16, 2021

(54) UNIVERSAL AUTOMATIC TENSIONING SYSTEM FOR ROLLER BLINDS AND AWNINGS WITH SIDE RAILS

(71) Applicant: Rollease Acmeda Inc, Stamford, CT (US)

(72) Inventor: Marco Raggini, Coriano (IT)

(73) Assignee: Rollease Acmeda Inc, Stamford, CT (US)

( * ) Notice: Subject to any disclaimer, the term of this patent is extended or adjusted under 35 U.S.C. 154(b) by 334 days.

(21) Appl. No.: 16/062,529

(22) PCT Filed: Dec. 16, 2016

(86) PCT No.: PCT/EP2016/081360
§ 371 (c)(1),
(2) Date: Jun. 14, 2018

(87) PCT Pub. No.: WO2017/108604
PCT Pub. Date: Jun. 29, 2017

(65) Prior Publication Data

US 2019/0024453 A1 Jan. 24, 2019

(30) Foreign Application Priority Data

Dec. 20, 2015 (EP) ..... 15201446

(51) Int. Cl.
*E06B 9/88* (2006.01)
*E06B 9/80* (2006.01)

(52) U.S. Cl.
CPC ..... *E06B 9/88* (2013.01); *E06B 9/80* (2013.01); *E06B 2009/805* (2013.01); *E06B 2009/885* (2013.01)

(58) Field of Classification Search
CPC ... E06B 9/581; E06B 9/80; E06B 9/88; E06B 2009/801; E06B 2009/804; E06B 2009/805; E06B 2009/885; E05C 17/085
See application file for complete search history.

(56) References Cited

U.S. PATENT DOCUMENTS 1,214,890 A * 2/1917 Bowen ..... E05C 17/085 217/60 D
1,683,844 A * 9/1928 Neveu ..... E06B 9/58 160/275

(Continued)

FOREIGN PATENT DOCUMENTS

DE 7500915 U 6/1975

*Primary Examiner* — Katherine W Mitchell
*Assistant Examiner* — Abe Massad
(74) *Attorney, Agent, or Firm* — Head, Johnson, Kachigian & Wilkinson, PC

(57) ABSTRACT

An universal automatic tensioning system, for roller blinds and awnings with side rails, comprising a crossbar (2) equipped with a spring pin (6) that can move along a side guide (3) that defines the rail for the shift of the awning (1), characterized in that it includes one or more fixed clip(s) (4) that can be hooked by the spring pin (6) causing the locking of the roller blind (1); a further movement of the awning's crossbar (2) will force the spring pin (6) engaging with a mobile flap (5) that works as a sort of "bridge" for the spring pin (6), causing the unlocking of the crossbar (2), so as to realize the setting for the automatic tensioning of the roller blind (1).

13 Claims, 9 Drawing Sheets

(56) References Cited

U.S. PATENT DOCUMENTS

| | | | | | |
|---|---|---|---|---|---|
| 1,972,182 | A * | 9/1934 | Chamberlain, Jr. | E06B 9/58 | 160/276 |
| 3,189,936 | A * | 6/1965 | Lee | E05C 17/32 | 16/82 |
| 3,911,992 | A * | 10/1975 | Webb | E06B 9/78 | 160/290.1 |
| 5,067,545 | A * | 11/1991 | Wilkins | E06B 9/325 | 160/178.1 R |
| 2014/0000820 | A1* | 1/2014 | Diamond | E06B 9/58 | 160/323.1 |
| 2015/0345215 | A1* | 12/2015 | Roberts | E06B 9/582 | 160/368.1 |

* cited by examiner

UNIVERSAL AUTOMATIC TENSIONING SYSTEM FOR ROLLER BLINDS AND AWNINGS WITH SIDE RAILS

TECHNICAL FIELD

Disclosed herein is a device for locking and tensioning roller blinds and awnings (e.g. automatic) having lateral guides or cables (e.g. a "Shy Zip" system, a vertical drop-down system, a roll-up system and a sloped "in traction" system).

BACKGROUND ART

The variety of awnings and roller blinds with side rails is growing. Vertical "free falling" type, horizontal and sloped "in traction" systems that are constrained by cables or belts are examples of awnings and roller blinds with side rails.

Awnings and roller blinds with side rails require that the fabric be tensioned in one or more positions (e.g. intermediate or at the point of max length) in order to maximize performance against the wind, to assist drainage and/or for the safety purpose. Tensioning of the fabric may be achieved with a manual lock system. In some cases an automatic tensioning system may be required (e.g. when a roller blind is external to a window, is located in a position that is not easily accessible and/or is controlled by a wind sensor).

Producers of awnings and roller blinds may provide tensioning devices. However, these tensioning devices may be limited to a specific application and may not be interoperable with systems provided by other producers. Drawbacks of current systems may include one or more of the following:

- not universal with regard to application of the device;
- not configured to operate simultaneously at two or more positions along the side rail;
- not able to be easily adjusted where installations are inaccurate (e.g. irregular measurements and dilatations of fabric);
- operability with "Shy Zip" rails is limited; and
- it may be difficult to exit from a "infinite loop problem" where the locking system fails (e.g. raising of the awning during a windstorm).

SUMMARY

Disclosed herein is a tensioning system for tensioning a roller blind or awning. The roller blind or awning may comprise a crossbar that is able to move in a first direction and a second direction that is opposite to the first direction. The tensioning system may comprise a first spring pin. The tensioning system may comprise a first clip. The first clip may comprise a protrusion configured to so cooperate with the first spring pin to inhibit movement of the roller blind or awning in the first direction to enable tensioning of the roller blind or awning when the first spring pin is in a tensioning position. The first clip may comprise a bridge configured to pivot between a first position, whereby the bridge engages the protrusion to allow the first spring pin to move past the protrusion in the first direction towards a released position, and a second position, whereby the bridge is spaced from the protrusion when the first spring pin is the tensioning position. The first spring pin may be configured to engage and pivot the bridge from the second position to the first position to allow the crossbar to move in the first direction towards the released position. Advantageously, the tensioning system disclosed herein may allow for tensioning and release (e.g. of the tensioning) of the roller blind to be automated (e.g. automatically moving the blind in the first and second direction, for example by using a motor, allows for the blind to be tensioned and released).

In some forms, the protrusion may be configured to cause the first spring pin to move against its bias when the crossbar is moved in the second direction from the released position towards the tensioning position.

In some forms, movement of the first spring pin against its bias allows the first spring pin to slide over the protrusion when the crossbar is moved in the second direction from the released position towards the tensioning position.

In some forms, further movement of the crossbar in the second direction from the released position towards the tensioning position causes the first spring pin to move with its bias such the first spring pin engages the protrusion in the tensioning position.

In some forms, in the tensioning position, engagement of the clip protrusion and spring pin inhibits movement of the crossbar in the first direction such that the roller blind or awning is able to be tensioned.

In some forms, in the tensioning position, further movement of the crossbar in the second direction causes the first spring pin to engage the bridge when the crossbar is in a hooking position.

In some forms, in the hooking position, further movement of the crossbar in the first direction causes the bridge to pivot from the second position to the first position to allow the crossbar to continue to move in the first direction towards the released position.

In some forms, the bridge is configured to cause the first spring pin to move against its bias when the crossbar is moved in the first direction from the hooking position towards the released position.

In some forms, movement of the first spring pin against its bias allows the first spring pin to slide over the bridge and protrusion when the crossbar is moved in the first direction from the hooking position towards the released position.

In some forms, the first spring pin and first clip are positioned on a first side of the roller blind or awning, and wherein the system further comprises a second clip and a second spring pin positioned on a second side of the roller blind or awning, the second side being opposite to the first side.

In some forms, the first and second clips are mounted to respective side rails or cables of the roller blind or awning in a position adjacent an end of the rails or cables to enable the roller blind or awning to be tensioned at the position adjacent the end of the rails or cables, and wherein the first and second spring pins are mounted to opposing ends of the crossbar.

In some forms, the first and second clips are mounted to respective side rails or cables of the roller blind or awning in a position intermediate a length of the rails or cables to enable the roller blind or awning to be tensioned at the position intermediate the length of the rails or cables, and wherein the first and second spring pins are mounted to opposing ends of the crossbar.

In some forms, the first and second clips are adjustable in position such that they are each able to be moved along the respective rails or cables into a position intermediate a length of the rails or cables.

In some forms, the tensioning device disclosed herein may address one or more of the above written drawbacks. In some forms, the tensioning device disclosed herein may merge into a single appliance a solution to one or more of the abovementioned problems.

In some forms, the system disclosed herein may ensure that locking of the awning at an intermediate or fully extended position and subsequently tensioning it by moving the awning with a manual winch or through an electric motor. In some forms, unlocking (e.g. release) of the roller blind may be performed simply by a brief movement in the "opposite direction" of the roller, followed by the movement in the correct direction.

In some forms, the system disclosed herein may be simply adaptable to different situations and awning models (various manufacturers), invisible, and/or inserted into side rails or located externally (covered by a box) for an awning having steel cable guides.

In some forms, the system disclosed herein may provide a high level of reliability in its functioning and allows easy position adjustments after possible deterioration of the fabric over the course of time.

In some forms, the system disclosed herein may be produced at low costs, with materials that are simply to locate in the market.

In some forms, the system disclosed herein may be used on roller blinds which are vertical or sloped at every angle, that may move in any direction, with or without the inclusion of a "Shy Zip" system.

In some forms, the system disclosed herein may ensure a solution to an "out of phase" case and of the consequential "infinite loop" problem, that may be a peculiar drawback of many existing systems.

In some forms, the system disclosed herein may be used for outdoor and indoor awnings, roller blinds and mosquito screens, where the awning/blind/screen has at least one crossbar that can move along a guide or a steel cable. The system may be made of two different parts. In some forms, a "static" device may be positioned on both side rails and a "dynamic" device may be positioned at the ends of the crossbar of the awning. In at least one embodiment, the static device may comprise a fixed clip at the top and a mobile flap positioned below it, the static device may be moved in different positions along the side rails, depending on necessity. In at least one embodiment, the dynamic device may be made up of a "spring pin" (cylindrical or different shaped), that may be kept elastically in contrast with the static device by a spring. Downward movement of the roller blind may cause the dynamic device to engage the static device, firstly in the fixed clip, to lock and tension the fabric (or panel), secondly engaging the mobile flap to unlock the awning, continuing the climb. As will be evident to the skilled addressee, in another embodiment, the static device may include the spring pin and the dynamic device may include the clip. In case of partial lock of the awning, the system disclosed herein may permit a smart and fast "reset" method, which may avoid an "infinite hook-release loop" problem.

BRIEF DESCRIPTION OF THE DRAWINGS

Various embodiments/aspects of the disclosure will now be described with reference to the following figures. The figures and accompanying description are merely for illustrative purposes without restricting the scope of the disclosure. Modifications and improvements to the disclosure will be readily apparent to those skilled in the art. Such modifications and improvements are intended to be within the scope of this disclosure.

DETAILED DESCRIPTION

Figure 1:
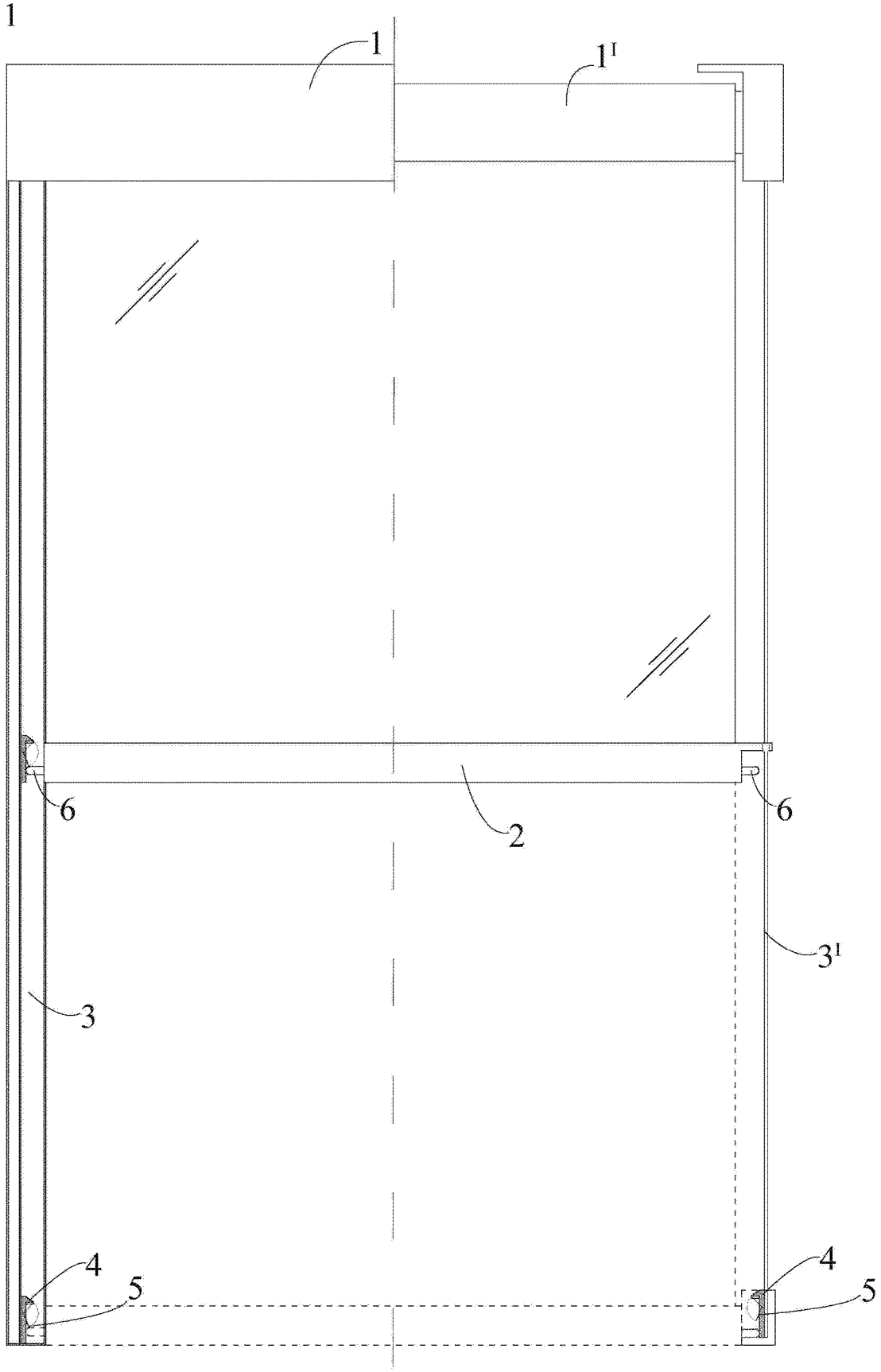
FIG. 1 is a perspective front view of the tensioning system, installed on a "sample awning" (with an aluminum guide on left side and a steel cable on the right side).
Figure 2:
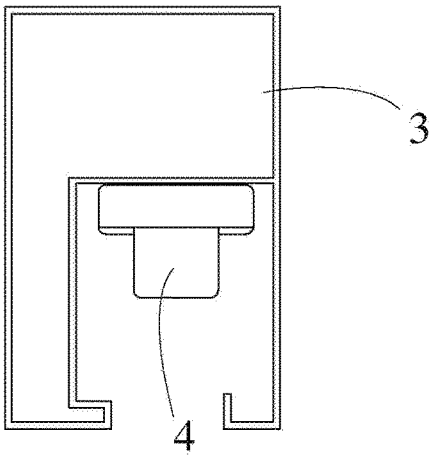
FIG. 2 is a sectional view of the "static part" of the tensioning system.
Figure 3:
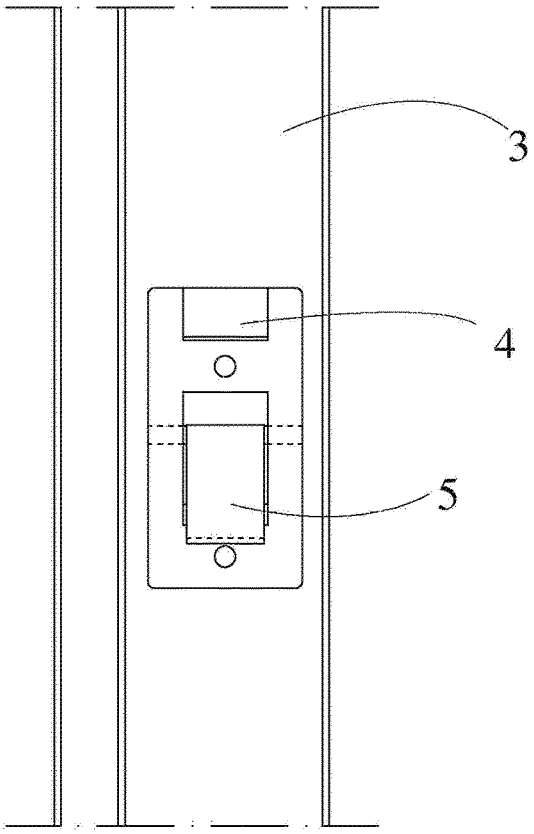
FIG. 3 is a front view of the "static part" of the tensioning system.
Figure 4:
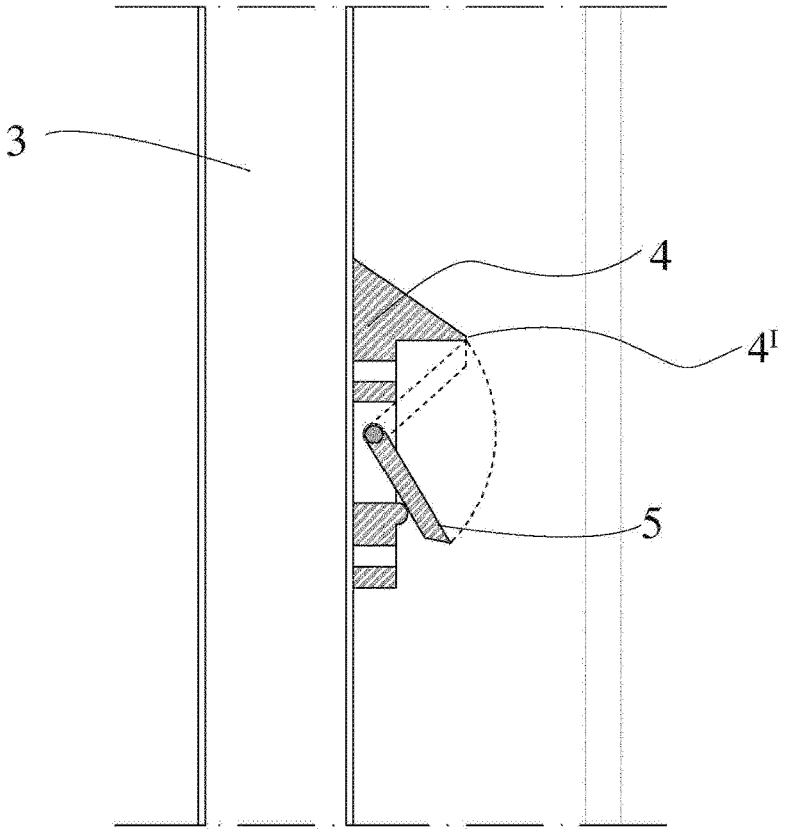
FIG. 4 is a side elevation view of the "static part" of the tensioning system.
Figure 5:
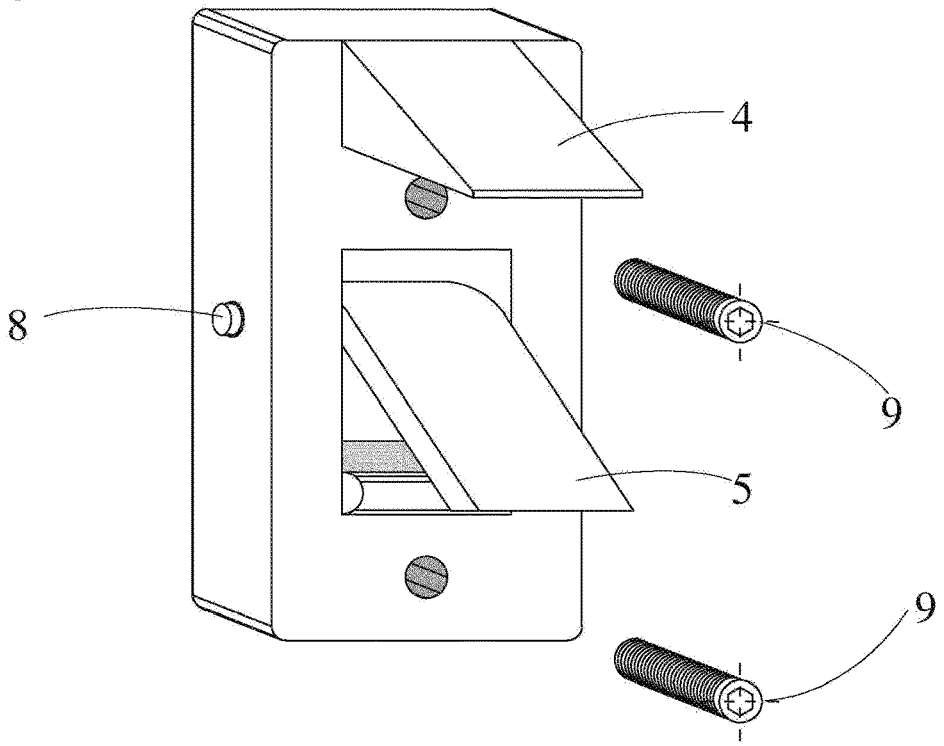
FIG. 5 is an exploded perspective front view of the "static part" of the tensioning system.
Figure 6:
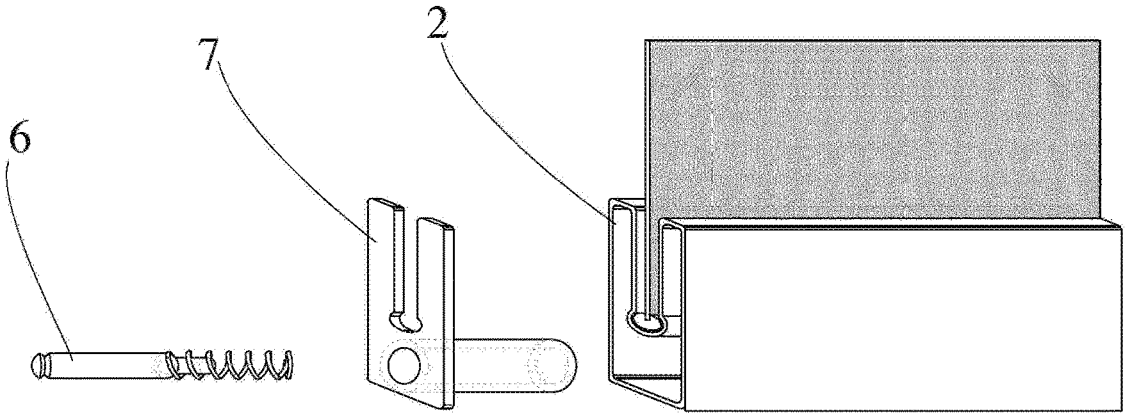
FIG. 6 is an exploded perspective front view of the "dynamic part" of the tensioning system.
Figure 6A:
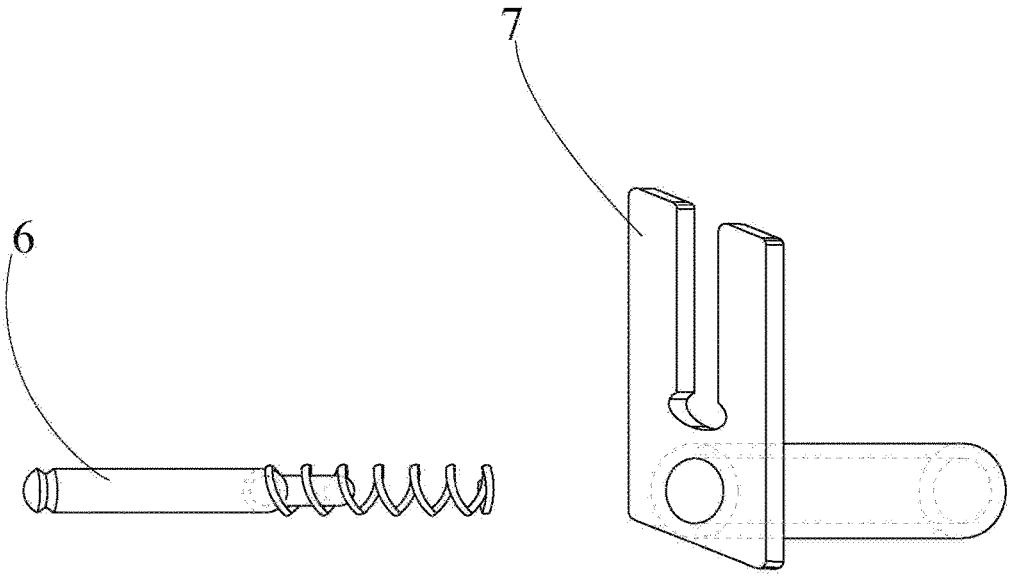
FIGS. 6*a*/6*b* represents further details of FIG. 6.
Figure 6B:
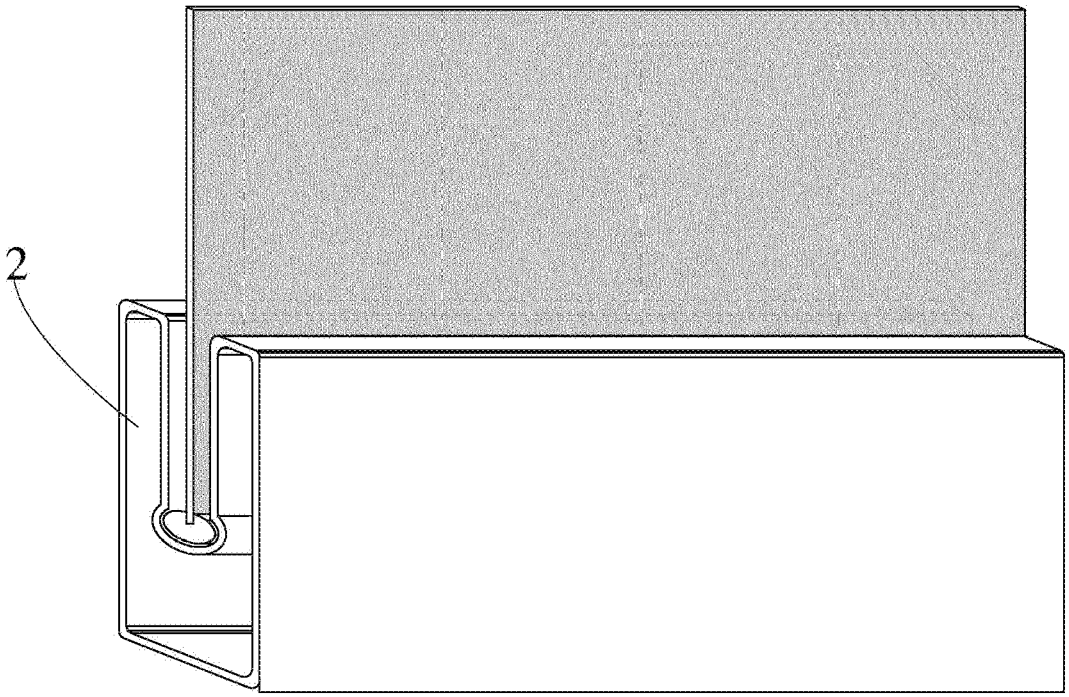
Figure 7:
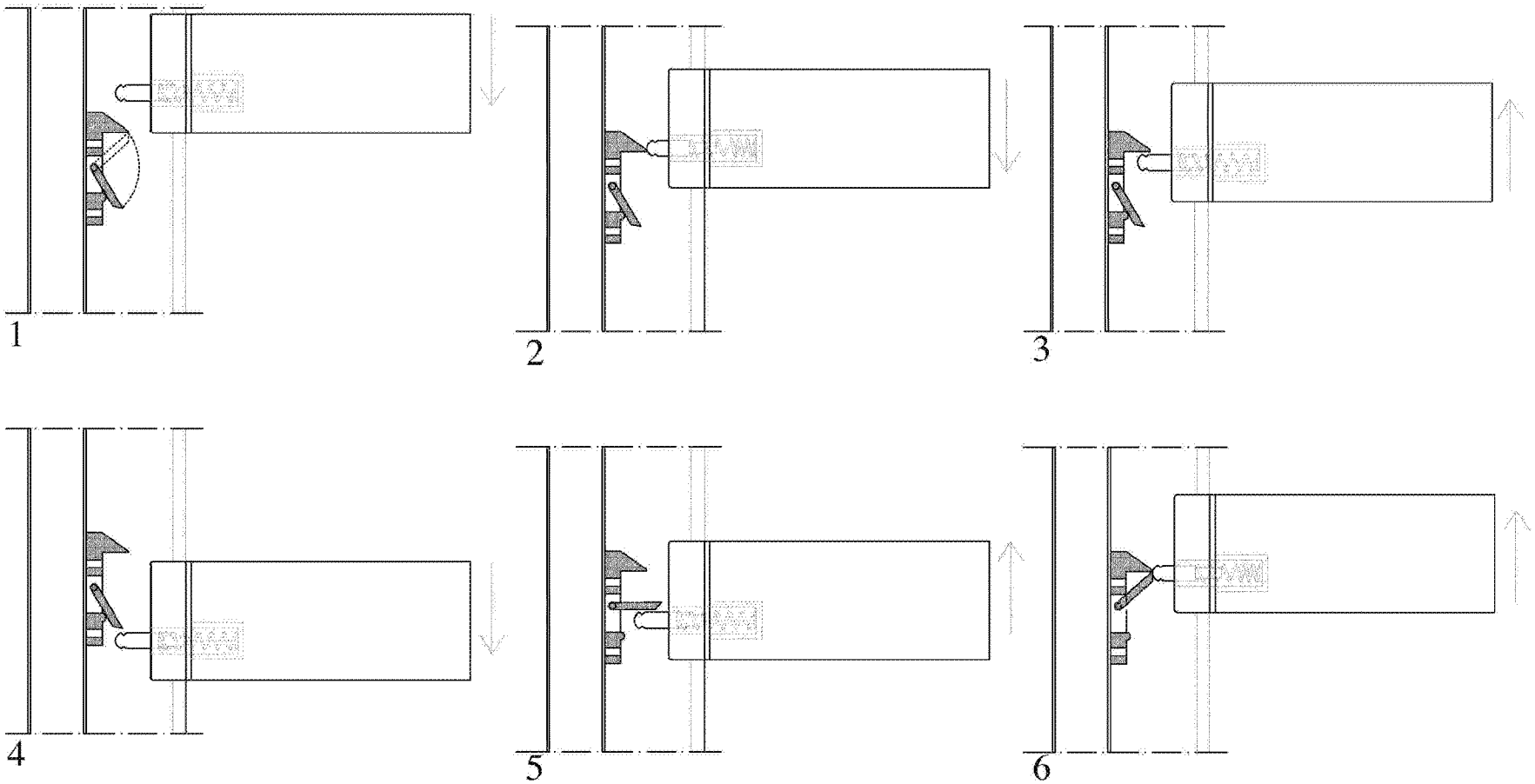
FIG. 7 shows some side elevation views of the whole tensioning system, as phases of the working mechanism; it highlights the interaction between the "static" and the "dynamic" devices.
Figure 7A:
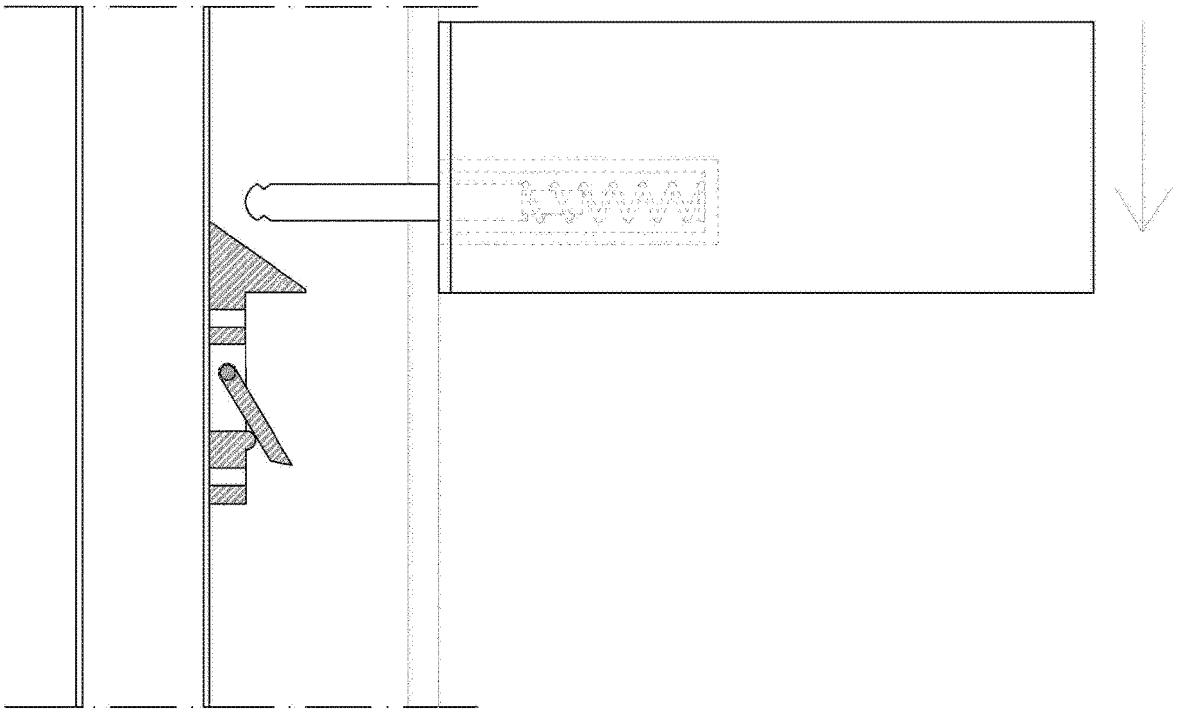
FIG. 7*a*-7*f* represents further details of FIG. 7, showing single phases of the tensioning system functioning.
Figure 7B:
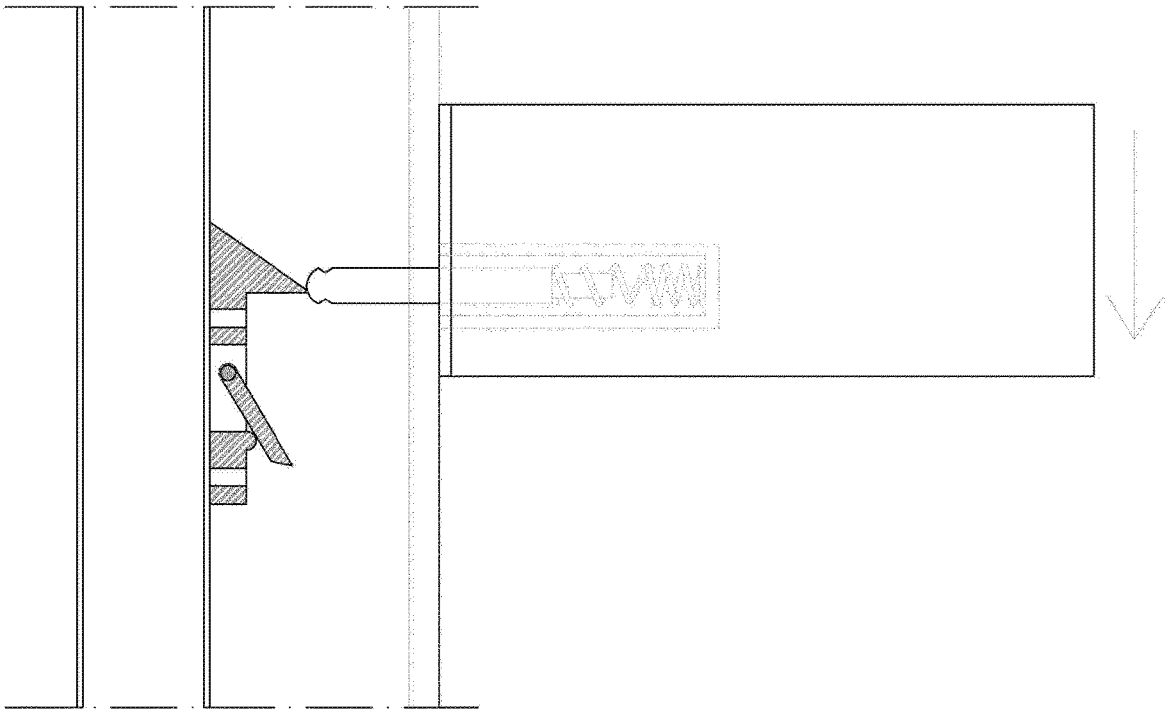
Figure 7C:
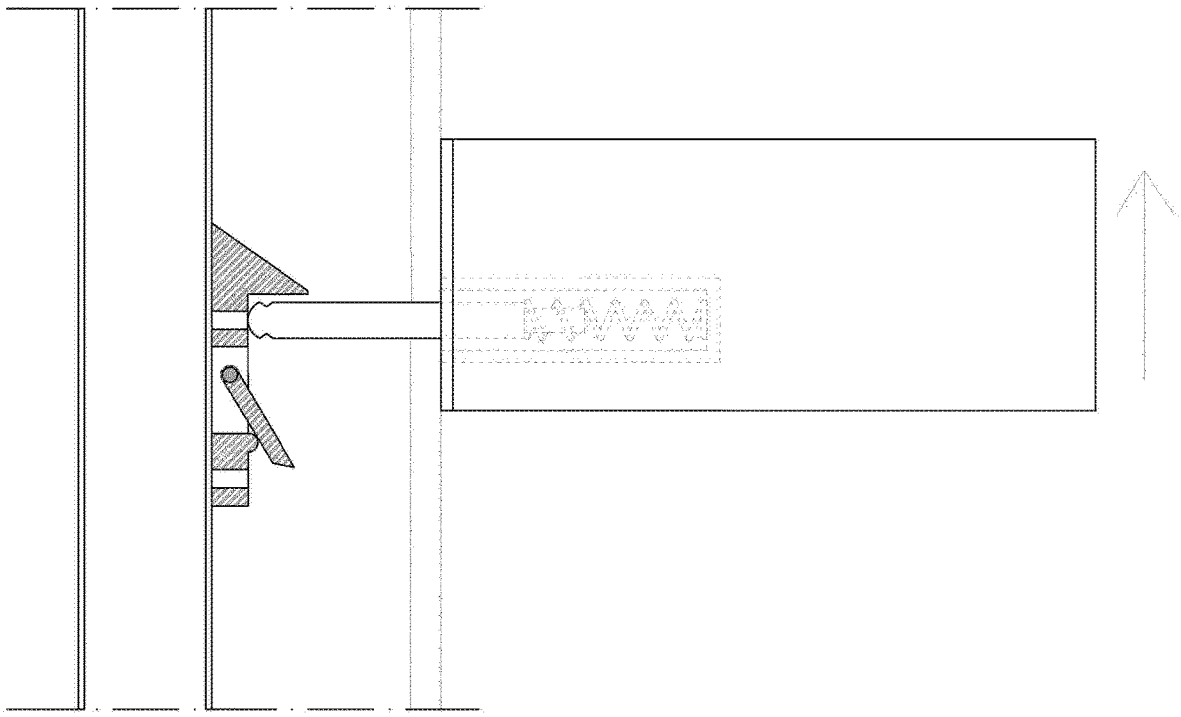
Figure 7D:
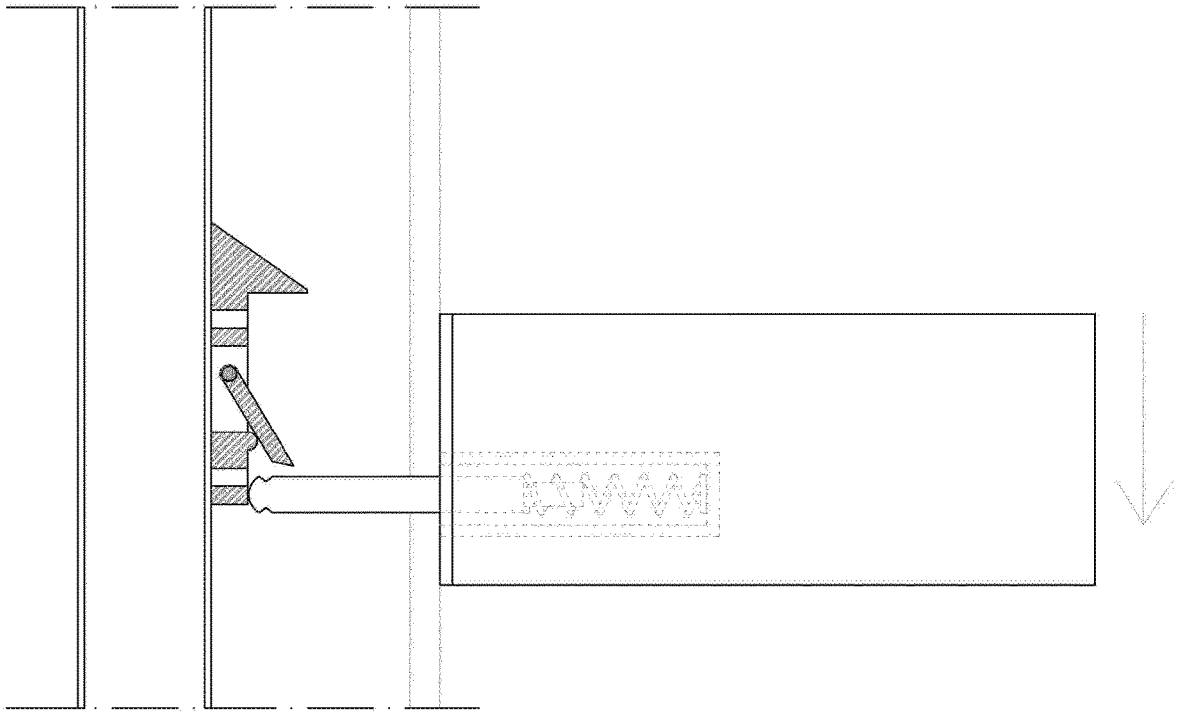
Figure 7E:
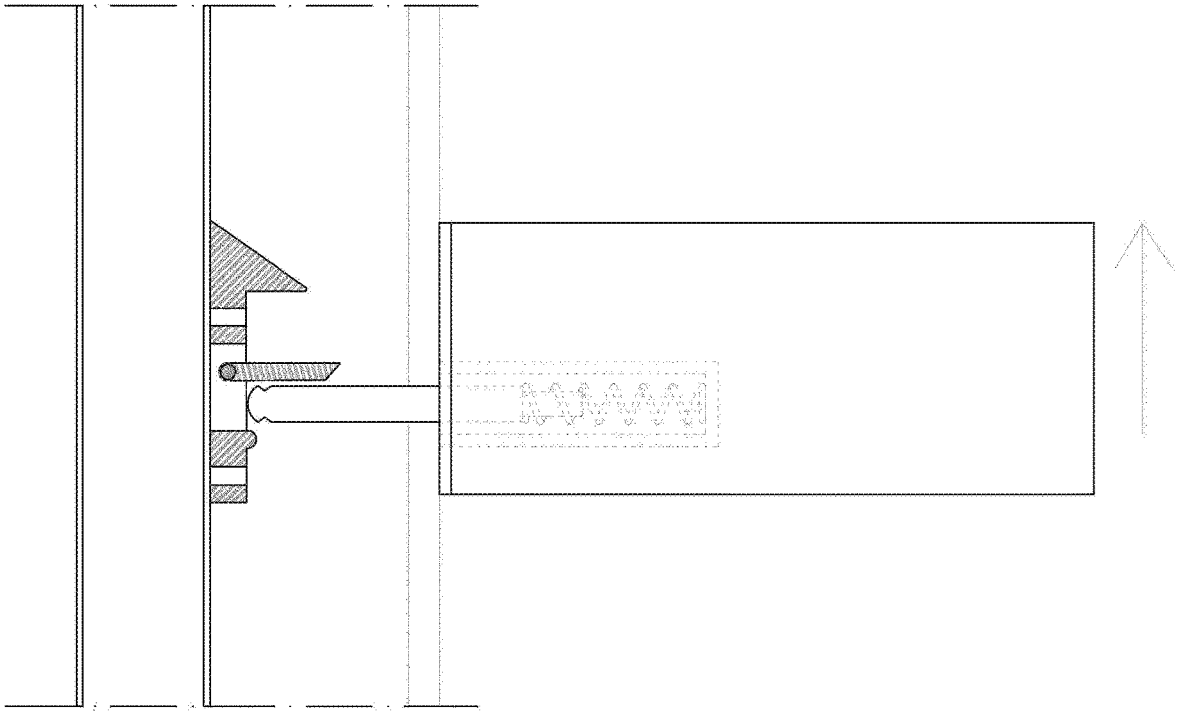
Figure 7F:
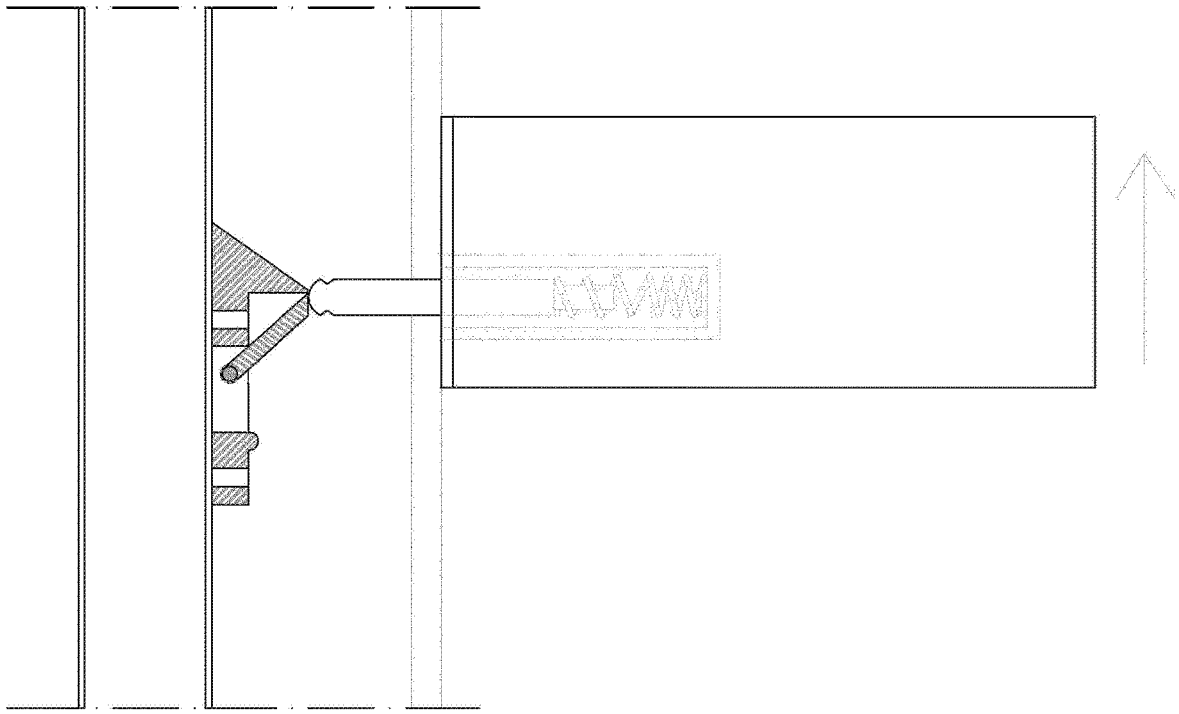

With reference to said figures, 1 indicates an awning or roller blind, having at least one crossbar, one roller and operation mechanisms (with or without a cover box), 2 the crossbar at the bottom side of the fabric, 3 the side rails (extruded aluminum guides or steel cables), 4 the fixed clip, 5 the mobile flap, 6 the spring pin, 7 the stopper of the crossbar, 8 a metal pin that allows the union between the fixed clip (4) and the mobile flap (5), 9 the metal screws that permit the securing and the shifts of the whole static part of the tensioning system along side rails (3).

The device works as follows: during the scrolling, in any position, the spring pin (6) flows along the side rails (3) and it comes up against the fixed clip (4); after it has exceeded completely the protrusion (4') the extension phase is ended and the reversion starts, so the spring pin (6) will be forced to stand still, allowing the tensioning of the fabric.

When the roller blind (1) is to be moved from lock position, firstly is scrolled enough to permit to the spring pin (6) the complete overtake of the mobile flap (5), secondly the awning (1) is scrolled in the opposite direction (manually or automatically with a motor) and now the spring pin (6) engages the mobile flap (5), that swings toward the protrusion (4') of the fixed clip (4), allowing to the crossbar (2) the bypassing of the lock position and the return to free moving.

It should be made clear that the use on roller blinds and awnings is a peculiar but not exclusive application of the automatic tensioning system according to the invention; is not excluded the possibility of using the tensioning system on different types of awning, blind, window, door and other similar.

In practice the construction details, shape, materials, dimensions and other aspects of the invention may change without derogate from the goal of this industrial patent.

Finally, all the elements can be replaced with other technically equal ones.

The invention claimed is:

1. A tensioning system for tensioning a roller blind or awning, the roller blind or awning comprising a crossbar that is able to move in a first direction and in a second direction that is opposite to the first direction, the system comprising:

a first spring pin; and a first clip comprising;

a protrusion configured to cooperate with the first spring pin to inhibit movement of the roller blind or awning in the first direction to enable tensioning of the roller blind or awning when the crossbar and the first spring pin are in a tensioning position; and a bridge configured to pivot between a first position, whereby the bridge engages the protrusion to allow the crossbar and the first spring pin to move past the protrusion in the first direction towards a released position, and a second position, whereby the bridge is spaced from the protrusion when the first spring pin is the tensioning position;

wherein the first spring pin is configured to engage and pivot the bridge from the second position to the first position to allow the crossbar to move in the first direction towards the released position; wherein the protrusion and the bridge are configured to cause the first spring pin to move against a bias of the first spring pin.

2. The tensioning system of claim 1, wherein the protrusion is configured to cause the first spring pin to move against its bias when the crossbar is moved in the second direction from the released position towards the tensioning position.

3. The tensioning system of claim 2, wherein movement of the first spring pin against its bias allows the first spring pin to slide over the protrusion when the crossbar is moved in the second direction from the released position towards the tensioning position.

4. The tensioning system of claim 3, wherein further movement of the crossbar in the second direction from the released position towards the tensioning position causes the first spring pin to move with its bias such the first spring pin engages the protrusion in the tensioning position.

5. The tensioning system of claim 4, wherein in the tensioning position, engagement of the clip protrusion and spring pin inhibits movement of the crossbar in the first direction such that the roller blind or awning is able to be tensioned.

6. The tensioning system of claim 5, wherein in the tensioning position, further movement of the crossbar in the second direction causes the first spring pin to engage the bridge when the crossbar is in a hooking position.

7. The tensioning system of claim 6, wherein in the hooking position, further movement of the crossbar in the first direction causes the bridge to pivot from the second position to the first position to allow the crossbar to continue to move in the first direction towards the released position.

8. The tensioning system of claim 7, wherein the bridge is configured to cause the first spring pin to move against its bias when the crossbar is moved in the first direction from the hooking position towards the released position.

9. The tensioning system of claim 8, wherein movement of the first spring pin against its bias allows the first spring pin to slide over the bridge and protrusion when the crossbar is moved in the first direction from the hooking position towards the released position.

10. The tensioning system of claim 1, wherein the first spring pin and first clip are positioned on a first side of the roller blind or awning, and wherein the system further comprises a second clip and a second spring pin positioned on a second side of the roller blind or awning, the second side being opposite to the first side.

11. The tensioning system of claim 10, wherein the first and second clips are mounted to respective side rails or cables of the roller blind or awning in a position adjacent an end of the rails or cables to enable the roller blind or awning to be tensioned at the position adjacent the end of the rails or cables, and wherein the first and second spring pins are mounted to opposing ends of the crossbar.

12. The tensioning system of claim 10, wherein the first and second clips are mounted to respective side rails or cables of the roller blind or awning in a position intermediate a length of the rails or cables to enable the roller blind or awning to be tensioned at the position intermediate the length of the rails or cables, and wherein the first and second spring pins are mounted to opposing ends of the crossbar.

13. The tensioning system of claim 12, wherein the first and second clips are adjustable in position such that they are each able to be moved along the respective rails or cables into a position intermediate a length of the rails or cables.

* * * * *